US010961777B2

(12) United States Patent
Bernhardsson et al.

(10) Patent No.: US 10,961,777 B2
(45) Date of Patent: Mar. 30, 2021

(54) LADDER TUBE FOR A COLLAPSIBLE LADDER

(71) Applicant: Telesteps AB, Tranås (SE)

(72) Inventors: Jens Bernhardsson, Limhamn (SE); Stina Karlsson, Limhamn (SE); Henrik Edvardsson, Malmö (SE); Niklas Ekstrand, Lund (SE); Carl-Johan Nelson, Bjärred (SE); Ulrik Gejervall, Forserum (SE)

(73) Assignee: Telesteps AB, Tranås (SE)

( * ) Notice: Subject to any disclaimer, the term of this patent is extended or adjusted under 35 U.S.C. 154(b) by 215 days.

(21) Appl. No.: 16/091,065

(22) PCT Filed: Apr. 4, 2017

(86) PCT No.: PCT/EP2017/058029
§ 371 (c)(1),
(2) Date: Oct. 3, 2018

(87) PCT Pub. No.: WO2017/174604
PCT Pub. Date: Oct. 12, 2017

(65) Prior Publication Data

US 2019/0119985 A1 Apr. 25, 2019

(30) Foreign Application Priority Data

Apr. 4, 2016 (SE) ..... 1650455-7

(51) Int. Cl.
*E06C 1/12* (2006.01)
*E06C 7/08* (2006.01)
(Continued)

(52) U.S. Cl.
CPC ..... *E06C 1/125* (2013.01); *E06C 1/18* (2013.01); *E06C 1/22* (2013.01); *E06C 7/00* (2013.01);
(Continued)

(58) Field of Classification Search
CPC ... E06C 1/125; E06C 1/12; E06C 7/08; E06C 7/083
See application file for complete search history.

(56) References Cited

U.S. PATENT DOCUMENTS 1,912,331 A * 5/1933 Wikstrand ..... E06C 1/12 182/207
4,592,446 A * 6/1986 White ..... E06C 1/125 182/100
(Continued)

FOREIGN PATENT DOCUMENTS

CN 101294479 A 10/2008
CN 203161061 U 8/2013
(Continued)

*Primary Examiner* — Colleen M Chavchavadze
(74) *Attorney, Agent, or Firm* — Capitol City TechLaw

(57) ABSTRACT

A ladder tube (10, 12) for use in a ladder section of a collapsible ladder (1) is provided. The collapsible ladder comprises several ladder sections (5, 5*a*-5*j*), where each ladder section comprises two ladder tubes (10, 12) arranged parallel to each other and interconnected by a rung (20) to form the respective ladder section, and where each ladder tube (10, 12) is telescopically inserted into a ladder tube (10, 12) of a lower section to form the collapsible ladder (1). The ladder tube (10, 12) is characterized in that it has a cross-sectional shape comprising at least one straight section (16) which at each end is connected at an angle larger than 90 degrees to at least one additional section (18) of the cross-sectional shape.

5 Claims, 7 Drawing Sheets

(51) Int. Cl.
*E06C 7/00* (2006.01)
*E06C 1/22* (2006.01)
*E06C 1/18* (2006.01)

(52) U.S. Cl.
CPC ..... *E06C 7/08* (2013.01); *E06C 7/081* (2013.01); *E06C 7/083* (2013.01)

(56) References Cited

U.S. PATENT DOCUMENTS 4,989,692 A * 2/1991 Min ..... E06C 1/125 182/166
5,738,186 A * 4/1998 Jones ..... E06C 1/125 182/195
6,708,800 B2 * 3/2004 Kieffer ..... E06C 1/125 182/195
8,215,453 B2 * 7/2012 Mickens ..... B60R 3/00 182/218
8,225,906 B2 * 7/2012 Kieffer ..... E06C 1/125 182/195
D677,799 S * 3/2013 Goransson ..... D25/64
D683,479 S * 5/2013 Goransson ..... D25/69
D692,163 S * 10/2013 Goransson ..... D25/64
D777,351 S * 1/2017 Holmberg ..... D25/64
D811,620 S * 2/2018 Bernhardsson ..... D25/69
D841,190 S * 2/2019 Mickens ..... D25/64
10,233,692 B2 * 3/2019 Kieffer ..... E06C 7/42
D879,327 S * 3/2020 Bernhardsson ..... D25/68
2009/0050407 A1 * 2/2009 Eriksson ..... E06C 1/18 182/195
2009/0078503 A1 * 3/2009 Eriksson ..... E06C 1/22 182/18
2019/0128064 A1 * 5/2019 Bernhardsson ..... E06C 1/18
2019/0136623 A1 * 5/2019 Kieffer ..... F16B 7/105

FOREIGN PATENT DOCUMENTS

CN 204225749 U 3/2015
CN 204386443 U 6/2015
DE 102006015927 A1 10/2007
FR 2818302 6/2002
GB 2233022 A 1/1991

* cited by examiner

LADDER TUBE FOR A COLLAPSIBLE LADDER

This application claims priority under 35 USC 119(a)-(d) to SE patent application No. 1650455-7, which was filed on Apr. 4, 2016, the entire contents of which are incorporated herein by reference.

TECHNICAL FIELD

The present invention relates to a ladder tube for use in a ladder section of a collapsible ladder comprising several ladder sections, where each ladder section comprises two ladder tubes arranged parallel to each other and interconnected by a rung to form the respective ladder section. Each ladder tube is telescopically inserted into a ladder tube of a lower section to form the collapsible ladder. The present invention also relates to an improved telescopic or collapsible ladder or a stepladder.

BACKGROUND

As well known by persons skilled in the art of collapsible ladders, such ladders usually comprise a number of tube portions having various diameters and which hence are telescopically insertable into one another. Every upper end of any of the tube portions are fastened to one end of a ladder step, whereas the other end of the ladder step is fastened to an upper end of a tube portion having the same diameter, the two tube portions and the ladder step forming a ladder section, the tube sections of which being insertable into an adjacent ladder section comprising tube portions having a larger diameter.

The resulting ladder can hence be collapsed by inserting higher ladder sections into lower ladder sections, and the ladder can be extended by extracting higher ladder sections from the lower ladder sections. A pin extending through the holes in the outer walls of two adjacent tube portions locks the tube portions to prevent the extended ladder from collapsing. Ladders having collapsible and expandable ladder sections are used in order to make the ladder smaller for storage and transport purposes.

The manufacturing process of a ladder tube involves several crucial steps, for example extrusion of the profile and measuring and drilling holes. Due to the construction of the ladder tubes in prior art, the manufacturing process is prone to mistakes leading to lower durability of the ladder.

It is the object of the present invention to provide a ladder tube and its corresponding collapsible ladder where its manufacturing process is improved and where the durability of the ladder is increased.

SUMMARY OF INVENTION

An object of the present invention is to provide a ladder tube for use in a ladder section of a collapsible ladder which increases the durability and improves the manufacturing process.

According to a first aspect, a ladder tube for use in a ladder section of a collapsible ladder is provided. The collapsible ladder comprises several ladder sections, where each ladder section comprises two ladder tubes arranged parallel to each other and interconnected by a rung to form the respective ladder section. Each ladder tube is telescopically inserted into a ladder tube of a lower ladder section to form a collapsible ladder. The ladder tube is characterized in that it has a cross-sectional shape comprising at least one straight section which at each end is connected at an angle larger than 90 degrees to at least one additional section of the cross-sectional shape, wherein the at least one additional section has a convex shape.

This cross-sectional shape allows for a relatively small cross section area while at the same time has a high resistance to bending. Hence, the durability of the ladder tube is increased and the cost of raw material is decreased.

Furthermore the ladder tube has a form which allows for an easy manufacturing process. The risk of deformation after an extrusion process is reduced if the tube has a straight section which it can rest while cooling down. Having a straight section is also beneficial as a reference point during the manufacturing process, for example during measurement and/or manufacturing of the holes.

The cross-sectional shape of the ladder tube may be asymmetrical. The ladder tube may be at least partly hollow.

The cross-sectional shape of the ladder tube may comprise one straight section, a first additional section connected to a first end of the straight section, a second additional section connected to a second end of the straight section, a third additional section connected to the first additional section, a fourth additional section connected to the second additional section, and a fifth additional section interconnecting the third and further additional sections.

The first, second, third, fourth and fifth additional sections may have convex shapes.

According to a second aspect, a collapsible ladder is provided. The collapsible ladder comprises several ladder sections, each ladder section comprises two ladder tubes arranged parallel to each other and interconnected by a rung to form the respective ladder section, and where each ladder tube is telescopically inserted into a lower ladder tube to form a collapsible ladder. The collapsible ladder is characterized in that each ladder tube has a cross-sectional shape comprising at least one straight section which at each end is connected at an angle larger than 90 degrees to at least one additional section of the cross-sectional shape. According to a third aspect, a collapsible stepladder is provided. The collapsible stepladder comprises a first and a second ladder leg, where the legs are hingedly connected to each other in one end, and where each of the ladder legs comprises several ladder sections. Each section comprises two ladder tubes arranged parallelly to each other and interconnected by a rung to form the ladder section. Each ladder tube is telescopically inserted into a ladder tube of a lower ladder section to form the collapsible stepladder comprising at least three ladder sections. The collapsible stepladder is characterized in that it comprises ladder tubes which each has a cross-sectional shape comprising at least one straight section which at each end is connected at an angle larger than 90 degrees to at least one additional section of the cross-sectional shape.

BRIEF DESCRIPTION OF THE DRAWINGS

In the following, the invention will be explained with reference to the accompanying drawings, where.

DETAILED DESCRIPTION OF EMBODIMENTS

Figure 1A:
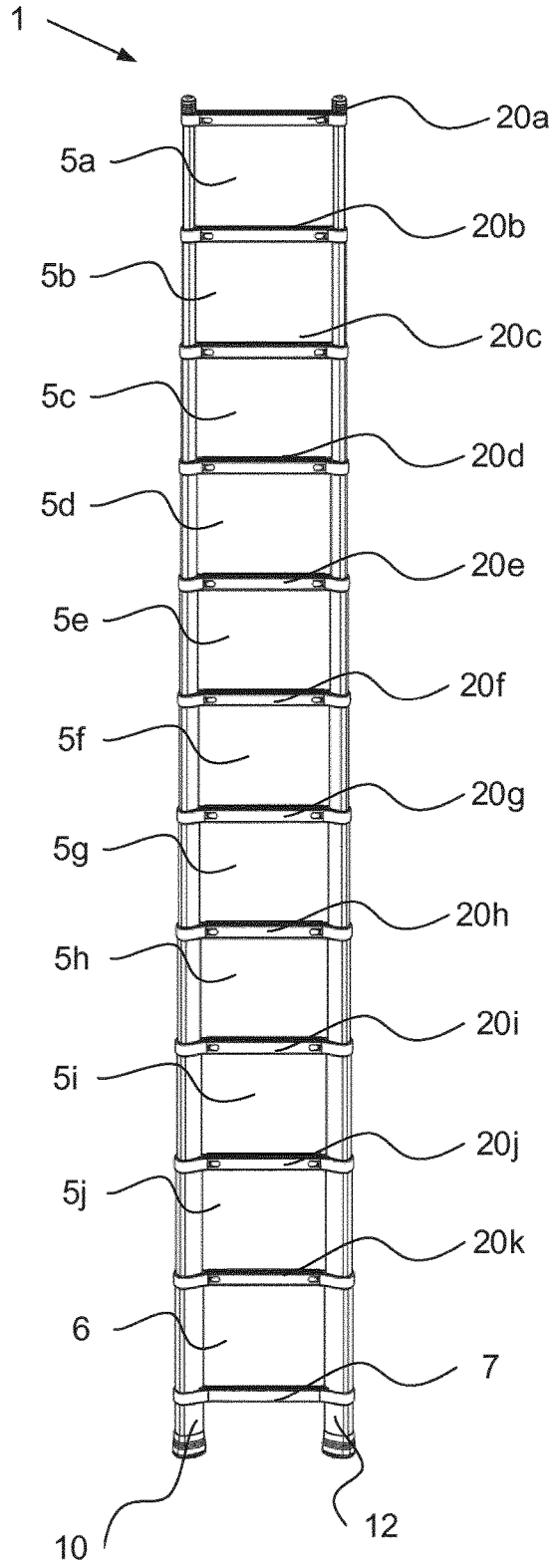
FIG. 1*a* is a front view of an extended ladder according to an embodiment.

In FIG. 1 a collapsible ladder 1 is shown in a fully extended state. The collapsible ladder 1 comprises several ladder sections 5*a-j* where each ladder section 5*a-j* comprises two ladder tubes 10, 12 and one rung 20*a-k*. The ladder sections are in a U-shaped form where the two ladder tubes 10, 12 are arranged parallel to each other and are interconnected at one end by one rung 20*a-k*. The rungs 20*a-k* are arranged horizontally between the vertically arranged ladder tubes 10, 12. The ladder tubes 10, 12 are divided into sections 5*a-j*, which telescope into each other. A section arranged higher than another lower section (for example section 5*a* is arranged higher than section 5*b*) has an outer diameter which is smaller than the inner diameter of the lower section. This allows the higher section to telescope inside the tube section between an extended state and a collapsed state.

Figure 1B:
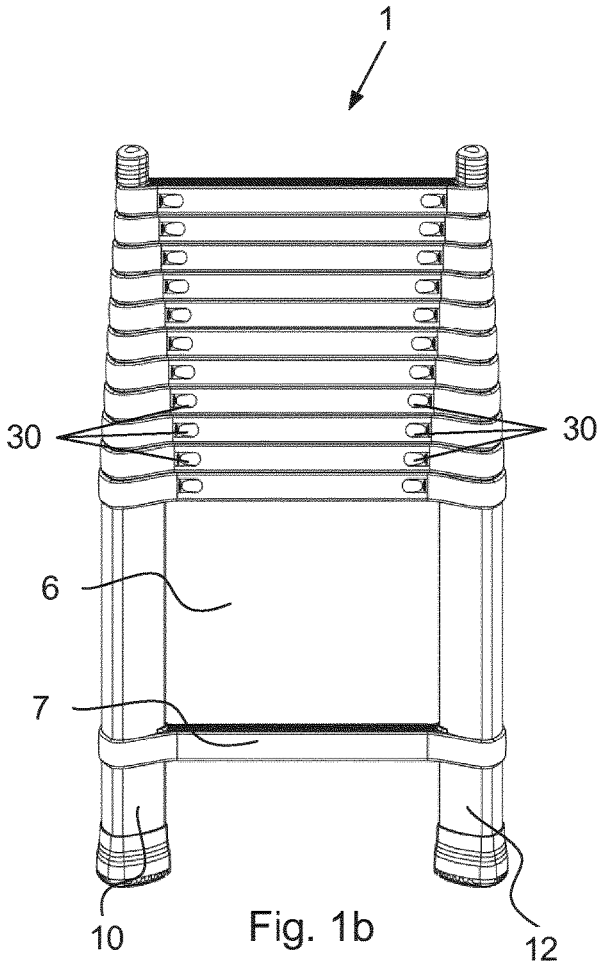
FIG. 1*b* is a front view of a maximally collapsed ladder according to an embodiment.

A maximally collapsed ladder is shown in FIG. 1*b*. The lowermost ladder section 6 comprises a stationary rung 7 which is provided at the bottom of the ladder, designed to provide an extra foot support and a more stable lowermost ladder section 6. A seen in FIG. 1*b*, the lowermost ladder section 6 is stationary and cannot be telescoped into the other sections 5*a-j*. The lowermost ladder section 6 may comprise two rungs, the stationary rung 7 and the rung 20*k*.

The ladder tubes 10, 12 may be provided with end portions on which the ladder stands. The end portions are thus arranged at the lowest part of the ladder tubes 10, 12. The end portions may be arranged with a material of high friction, thus lowering the risk of the ladder moving during use.

In order to telescopically collapse and expand the ladder, a locking or retaining mechanism may be provided. In the embodiment shown in FIGS. 1*a-b* a retaining mechanism comprises a plurality of actuators 30 arranged on each individual rung 20*a-k* in order to release the respective sections 5. The retaining mechanism comprise a spring-loaded locking pin 27 (see FIG. 5*a-c*) which locks a ladder section 5*a* in relation to another adjacent ladder section 5*b* by being inserted into locking holes 17 in the ladder tube (see FIG. 3*d*). Each section 5*a-j* is individually released by using actuators 30 (such as rotary buttons or slide buttons) arranged on both sides of the rung 20. By using the actuators 30, for example sliding slide buttons towards each other, the locking pins 27 are withdrawn from the respective locking holes 17 in the ladder tube 10, 12. Such a retaining mechanism is described in the European patent EP120021203, which is hereby incorporated by reference.

In one embodiment the ladder only comprises one pair of actuators which for example are arranged on the front side of the second lowermost rung. The single pair of actuators will still be able to collapse the entire ladder. Alternatively, the ladder comprises a first pair of actuators arranged on the second uppermost ladder rung and a second pair of actuators arranged on a rung positioned between the second uppermost rung and the second lowermost rung. The second pair of actuators enables the lowering of a lower part of a collapsible ladder and the first pair of actuators enables the lowering of an upper part of the collapsible ladder. Such actuators are described in the European patent EP1728966, which is hereby incorporated by reference.

In a further embodiment the pin of the lowest ladder section may be withdrawn from interaction with its respective holes in the tubes of the neighboring ladder section by manipulating a foot control located and arranged to maneuvered by a foot of a user of the ladder. Such a locking mechanism is described in the international application WO20120020333, which is hereby incorporated by reference.

It should be noted that although only some types of locking/retaining mechanisms are mentioned herein, any type of mechanism suitable to collapse and expand a telescopic ladder could be used.

Figure 2A:
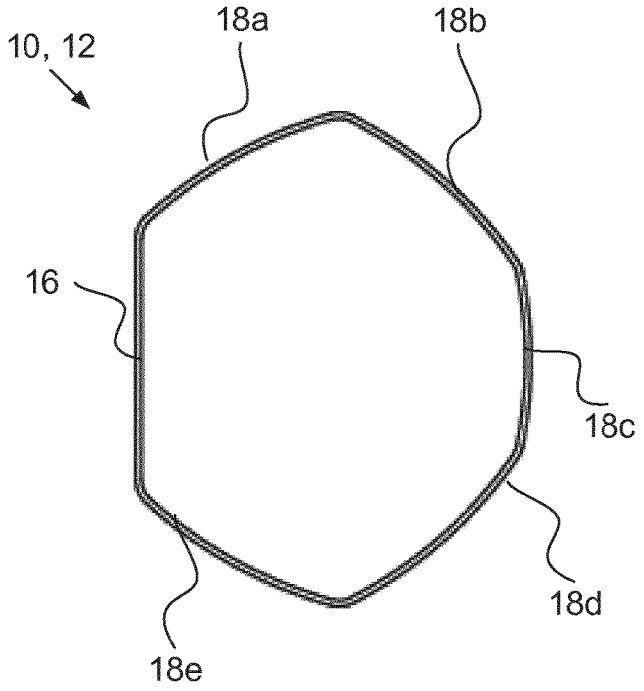
FIG. 2*a-c* each shows a cross section view of a ladder tube according to different embodiments.
Figure 2B:
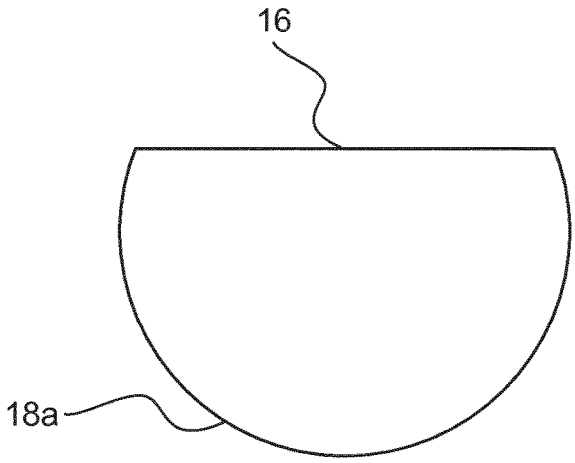
Figure 2C:
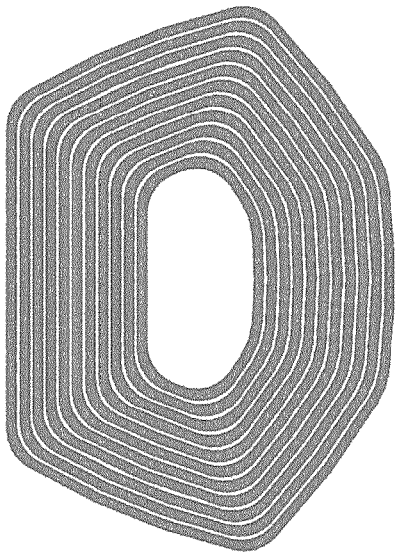

Different embodiments of a cross-sectional shape of a ladder tube are shown in FIGS. 2*a-c*. The cross-sectional shape comprises at least one straight section 16 and at least one additional section 18. The cross-sectional shape may have any number of additional sections 18. The number of additional sections may be one, two, three, four, five, six and so on. The section or sections may comprise one side. The additional section/sections may be straight, concave, convex or otherwise rounded. Furthermore, the cross section may be symmetrical or asymmetrical.

It is beneficial if the cross-sectional shape has a relatively small cross section area to decrease the material costs. At the same time it is beneficial to have a shape which has a high resistance to bending. The section modulus is highly dependent on the cross sectional shape.

Furthermore the ladder tube 10, 12 should have a form which allows for an easy manufacturing process. The manufacturing process involves several crucial steps, for example extruding the profile which the ladder tube 10, 12 may be constructed from, measuring where the locking holes should be placed and actually perform the manufacturing of the holes. Having a tube 10, 12 with a cross section comprising a straight side 16 improves the quality of the performance of these steps.

The ladder tube 10, 12 may be formed as an extruded aluminum profile. If high temperature extrusion is used for this process, the risk of deformation after the extrusion process is reduced if the tube 10, 12 has a straight section which it can rest while cooling down.

Having a straight section 16 is also beneficial as a reference point during the manufacturing process. Measuring and manufacturing the locking holes requires high precision. A straight section 16 makes it easier to restrain the ladder tube 10, 12 during the measurement and/or manufacturing of the holes and thus increases the precision obtained. The holes may for example be manufactured using punching, drilling, milling or electrical discharge machining. The straight section 16 is thus used as a technical surface during manufacturing.

Having a ladder tube having a cross-section comprising only of straight sections 16 would however not be desirable. Such a construction would be less resistant to bending and would not have a sufficient torsional stiffness. A desirable construction thus has a cross-sectional shape having at least one straight section 16 and at least one additional section which is not straight.

In one embodiment shown in FIG. 2*a*, the cross-sectional shape comprises a straight section 16. This straight section is a straight side which at each end is connected to one additional section 18*a*, 18*e*. The connections between the straight section 16 and the two additional sections 18*a*, 18*e* are both arranged with a connecting angle larger than 90 degrees. The connecting angle may for example be an obtuse angle, i.e. more than 90 degrees but less than 180 degrees.

The present inventors have realized, after insightful consideration, that a ladder tube that has a cross-sectional shape comprising only one straight section 16 and at least three additional sections 18*a-e*, being non-straight, a better ladder tube may be provided in a novel and inventive way. In an even more preferred embodiment, the ladder tube comprises a five additional sections 18*a*-18*e* that all have a convex shape.

In the embodiment shown in FIG. 2*a*, the cross section comprises in total six sections; a straight section 16 and five additional sections 18*a-e*. The first additional section 18*a* is connected to a first end of the straight section 16, a second additional section 18*e* is connected to a second end of the straight section 16, a third additional section 18*b* is connected to the first additional section 18*a*, a fourth additional section 18*d* is connected to the second additional section 18*e*, and a fifth additional section 18*c* interconnects the third and further additional sections 18*b*, 18*d*. The first second, third, fourth and fifth additional sections 18*a*-18*e* all have convex shapes.

The additional concave sections 18*a* have the benefits that they provide a better resistance to bending and a higher torsional (or rotational) stiffness. When the ladder tubes are mounted in to a telescoping pipe assembly, the cross-sectional shape will allow the ladder tubes 10, 12 to retain in their position, not doing torsional movement, which makes the whole ladder construction stiff. Hence, there is no need for any additional steering parts to get the ladder tubes to only move linearly. Torsion, i.e. twisting, of the ladder tube 10, 12 is highly undesirable since the plurality of ladder tubes 10, 12 are telescopically arranged.

Furthermore, having a cross-sectional shape comprising one straight section 16 and at least one additional concave section has benefits during the assembly step during the manufacturing process. The assembly process is easier and less prone of mistake thanks to the additional sections 18 being of a different shape than the straight section 16, hence the user performing the assembly of the ladder 1 has reduced possibilities on how to assemble the ladder 1. Thus having the combination of non-straight sections 18 and a straight section 16 in the ladder tube 10, 12 has the benefits that the ladder tube 10, 12 is less likely to be mistakenly arranged in its respective rung 20.

Although not shown, it should be noted that the cross-sectional shape may for example also comprise a combination of two straight sections and four additional sections or three straight sections and three additional sections.

In the embodiment shown in FIG. 2*b*, the cross-sectional shape of a ladder tube comprises a straight section 16 and one additional section 18*a*. The straight section 16 is at each end connected at an angle larger than 90 degrees to at least one additional section 18*a*. The connecting angle at each side of the straight section 16 is approximately 100-120 degrees. The additional section 18*a* is in a form of a semicircle.

FIG. 2*c* shows a top view of cross sections of several ladder tubes telescopically arranged in a collapsible ladder 1. The diameter of the cross-section of the tube being at the top, i.e. the tube arranged in the center of the tubes, is the smallest. In order for the ladder tubes to be able to be telescopically inserted into each other, the ladder tubes 10, 12 have to be at least partly hollow.

Figure 3A:
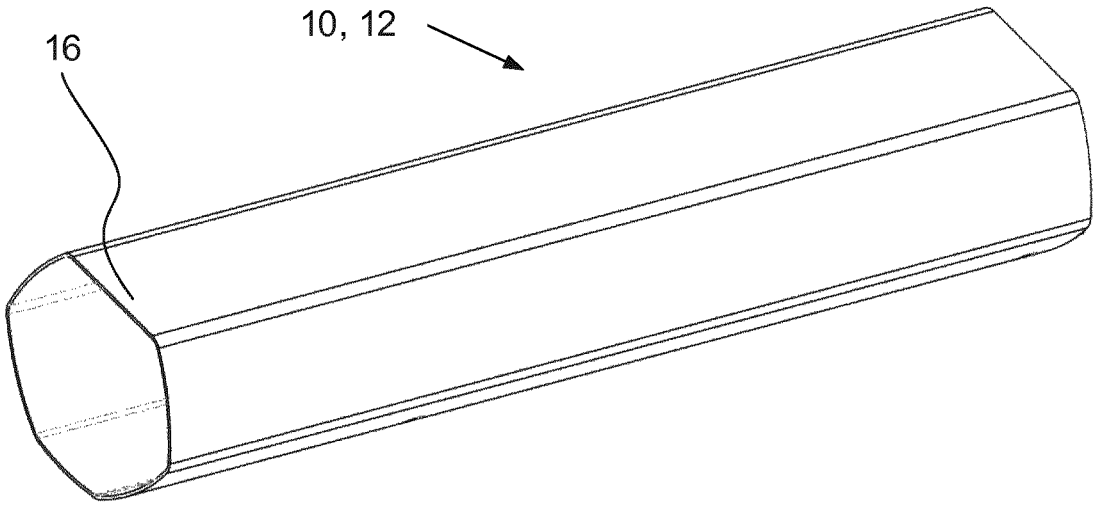
FIGS. 3*a-b* each shows an isometric view of a ladder tube according to different embodiments.

FIGS. 3*a-d* each shows an embodiment of a ladder tube 10, 12. In FIG. 3*a* a part of an exemplified embodiment of a ladder tube 10, 12 having the cross-sectional shape as discussed in relation to FIG. 2*a* is shown. The suitable length of the ladder tube 10, 12 may vary depending on national standards and the design of the ladder. The length of the ladder tube 10, 12 depends on the desired distance between the rungs. The distance between the rungs 20 may be controlled by different standards, for example the recommended distance between the rungs according to European standards is 250-300 mm.

Figure 3B:
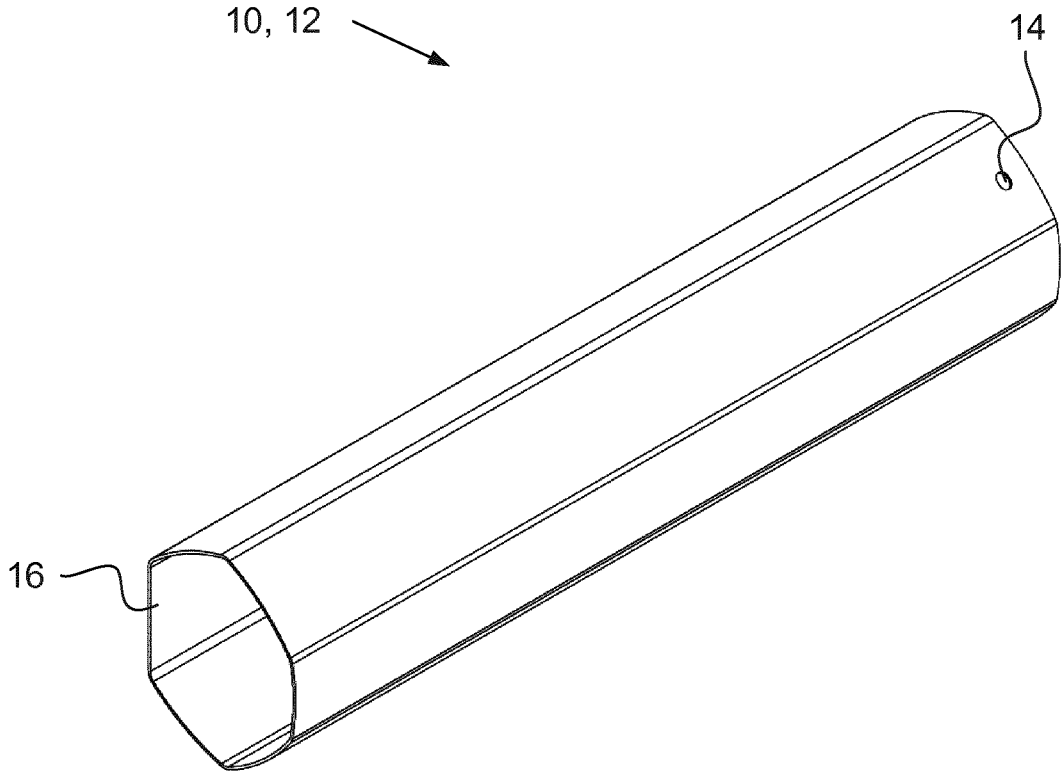

FIG. 3*b* shows an embodiment where the tube 10, 12 comprises a first mounting hole 14. The first mounting hole 14 corresponds to a rung protrusion 28 (See FIG. 4*a-e*) arranged on each bracket section 24*a*, 24*b* of the rung 20, the cooperation between the first mounting hole 14 and the rung protrusion 28 allows the rung to be securely arranged on the ladder tube 10, 12. The ladder tube 10,12 arranged at the bottom section 6 differs from the one seen in FIG. 3*b* by the arrangement of two rungs 7, 20*k*. The tube 10,12 arranged at the bottom section 6 thus comprise two first mounting holes (not shown).

Figure 3C:
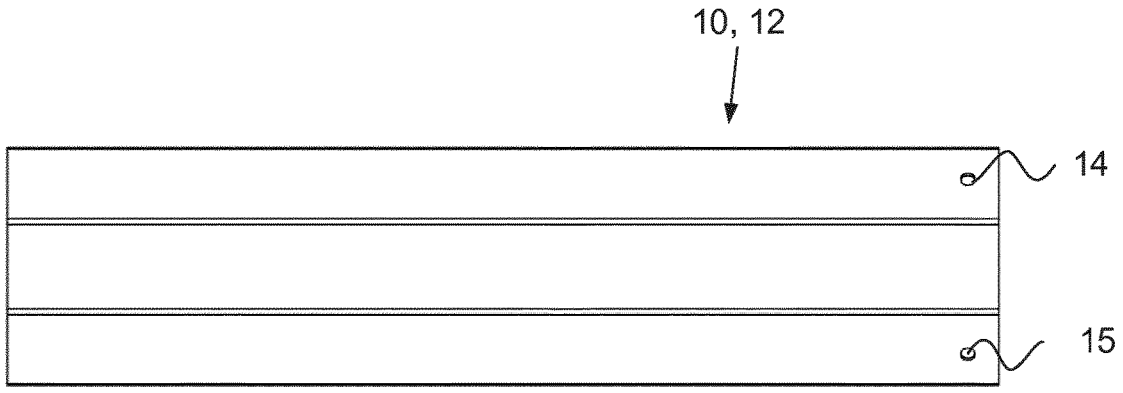
FIGS. 3*c-d* each shows a top view of a part of a ladder tube according to different embodiments.

FIG. 3*c* shows another embodiment of the ladder tube 10, 12 comprising a first mounting hole 14 and a second mounting hole 15. Each rung 20 is thus arranged with at least two rung protrusions 28 which will fixate the rung 20 to the corresponding first and second mounting holes 14, 15.

Figure 3D:
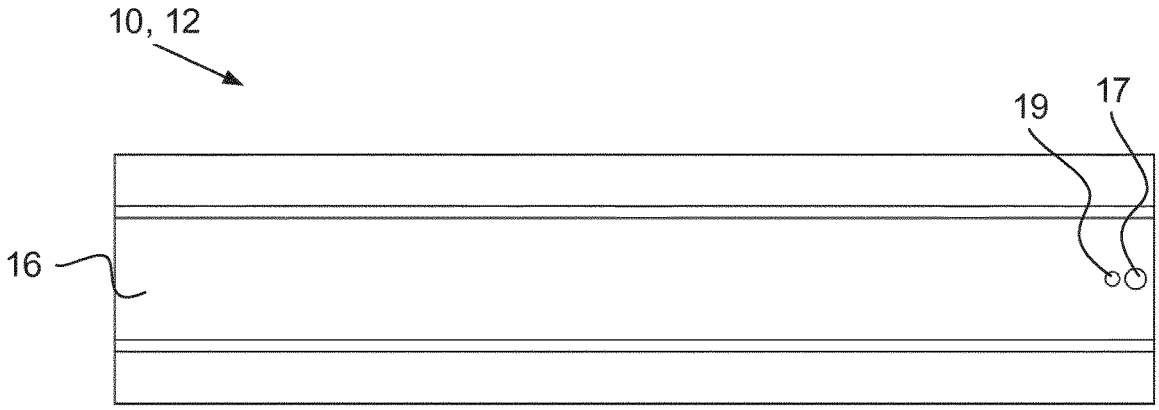

FIG. 3*d* shows an embodiment of a part of a tube 10, 12 showing the straight section 16 and two additional sections. In this embodiment the locking mechanism of the ladder comprises a locking pin 27 and a corresponding locking hole 17. The locking hole 17 is arranged on the straight section 16 of the ladder tube 10, 12. The locking hole 17 is arranged to receive the locking pin 27. The straight side 16 of the tube 10, 12 also comprises a third mounting hole 19 which together with a corresponding rung protrusion 28 helps to arrange the rung 20 to the tube 10, 12.

In one embodiment each rung 20*a* is arranged to the tube using three rung protrusions 28*a-c* which each corresponds to a first mounting hole 14, a second mounting hole 15 and a third mounting hole 19. It should be noted that the first, second and third mounting holes 14, 15, 19 may be arranged on other sections than shown herein, depending on the cross-sectional shape of the ladder tube 10, 12.

It should also be noted that the tubes 10, 12 may comprise more holes, for example fastening holes for devices preventing the ladder from being accidently pulled apart.

Figure 4A:
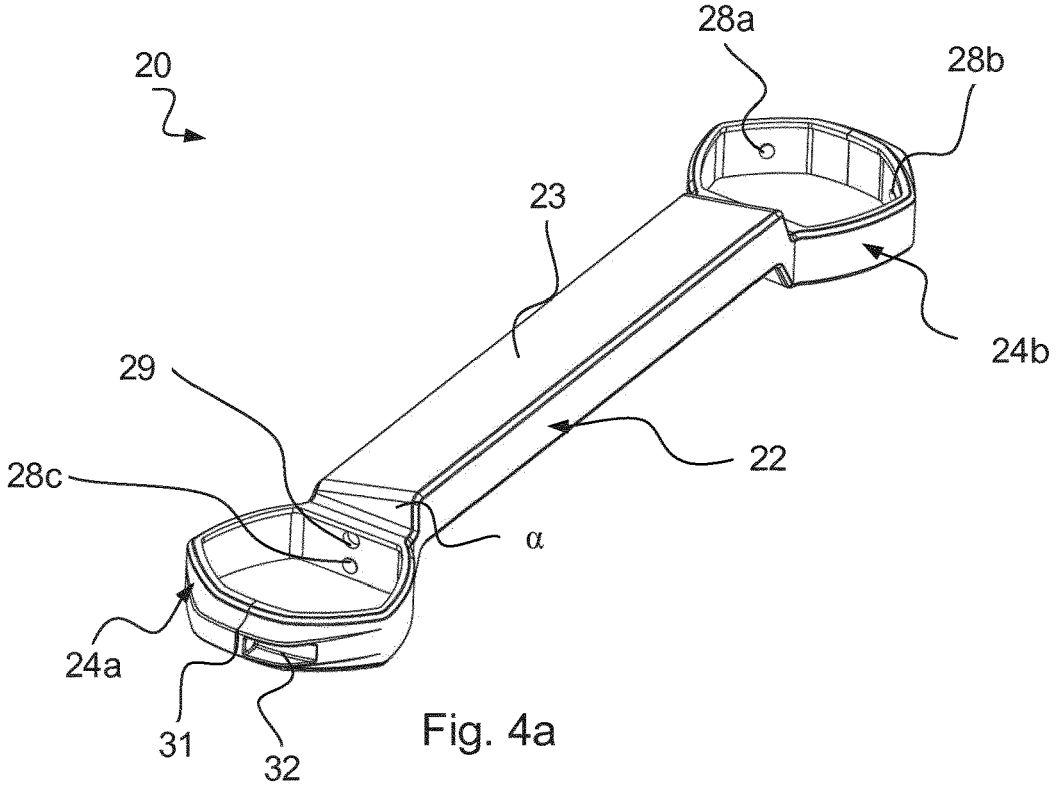
FIGS. 4*a-e* show different views of a rung according to an embodiment.
Figure 4B:
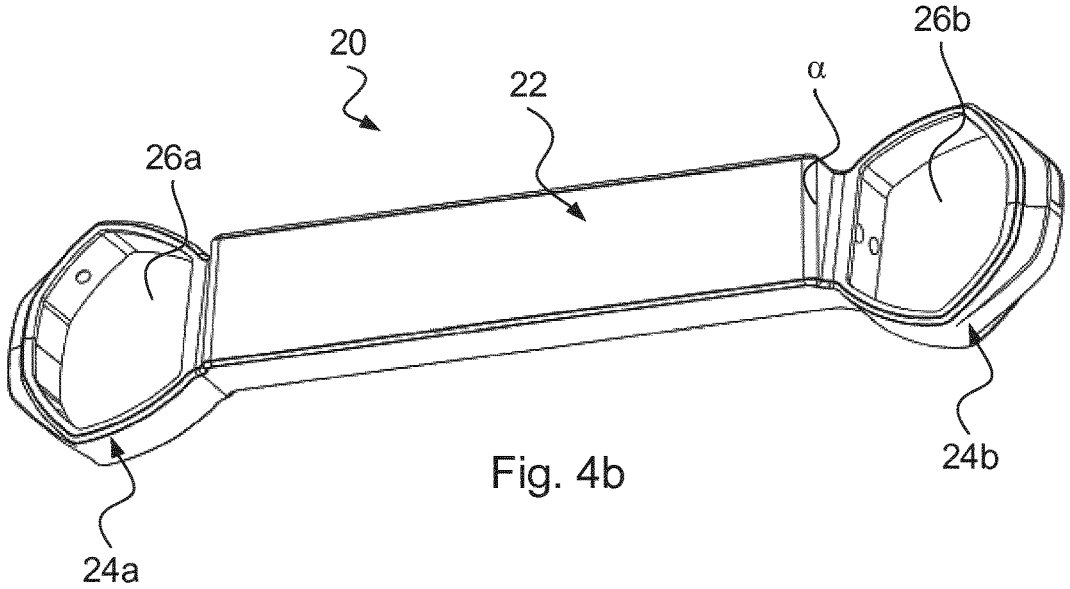
Figure 4C:
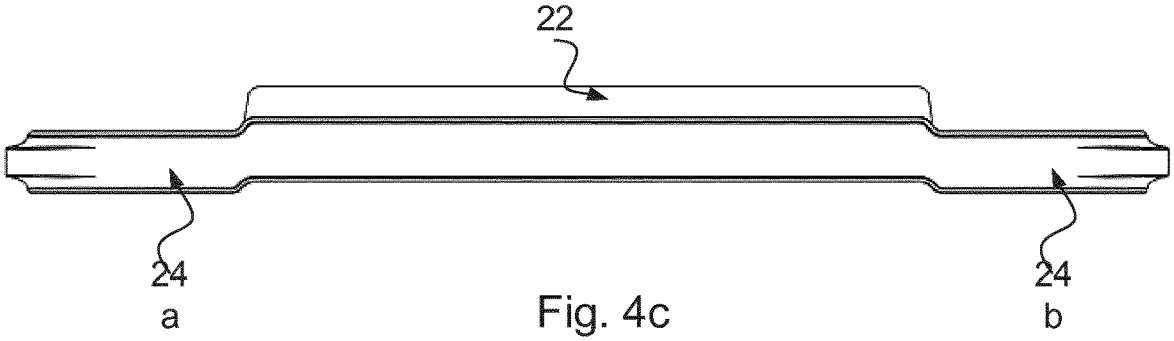

In FIGS. 4*a-c* an embodiment of a rung 20 is shown in different perspective views. Each rung 20 comprises a main section 22, a first bracket section 24*a* and a second bracket section 24*b*. The first and second bracket sections 24*a-b* are arranged at each end of the rung 20 to receive the respective ladder tube 10, 12. Each bracket section 24*a-b* is arranged with an opening 26*a*, 26*b* having the same shape as the cross-sectional shape of the corresponding ladder tube 10, 12. As have been discussed in relation to FIGS. 2 and 3, the cross-sectional shape of the ladder tube 10, 12 may have a distinctive form. To further improve the manufacturing process, the straight section 16 of the ladder tube 10, 12 may be arranged in the bracket section so that it is facing the main section 22

The two bracket sections 24*a*, 24*b* may be identical and symmetrical to one another, i.e. the first bracket section 24*a* could be arranged on either the first or second ladder tube 10, 12.

The rung 20 is provided as a single integrated unit, where the main section 22, the first bracket section 24*a* and the second bracket section 24*b* are one single piece. The main section 22 and the first and second bracket sections 24*a-b* are formed by the same material. The material may for example be a polymer. In one embodiment the material is a thermoplastic material. The thermoplastic material may for example be a polyamide, such as for example nylon. The material may be reinforced by adding compositions of glass fibers.

The feature of the rung 20 being formed as an integrated unit provides several benefits to the construction of the collapsible ladder. For example, since the new improved ladder 1 consists of fewer separate parts the assembly of the collapsible ladder is simplified. The production time is thus decreased leading to lower productions cost.

In prior art system the first and second bracket sections were attached to the main section of the rung using for example by means of press fit. This attachment step generally causes problem when performing quality tensile tests, since the parts may disconnect from each other. By providing the rung 20 as an integrated unit this problem is diminished. The durability of an integrated rung 20 is increased, especially when quality testing the ladder using tensile tests.

The main section 22 of the rung 20 is slightly inclined to provide a more user friendly ladder 1. In one embodiment, the main section 22 is inclined with an angle α with respect to a horizontal plane. The angle α may range between 10 and 20 degrees, and more preferably around 15 degrees.

The main section 22 of the rung comprises a step surface 23, which is the surface which the user is intended to place its feet during use of the ladder. In one embodiment, at least a portion of the step surface 23 of the main section 22 of the rung 20 is provided with a plurality of depressions or protrusions (not shown). The depressions or protrusions may be provided in different patterns, such as for example arranged on a plurality of lines. The individual depressions or protrusions may have the form of a circle, a cube, a line or any other suitable form. These depressions or protrusions provide a rung surface 23 which provides a better grip for the user to stand on. The risk of slipping is therefore decreased. These depressions or protrusions may be constructed in integral with the rest of the rung 20.

In one embodiment, at least a part of the step surface 23 is provided with an outer layer (not shown). The outer layer may be provided with either a plurality of depressions or protrusions arranged in different patterns and/or the outer layer may be a soft layer increasing the comfort for the user standing on the rung 20.

In one embodiment the rung 20 comprises three rung protrusions 28*a-c* arranged to fit the first, second and third mounting holes 14, 15, 19 of the ladder tube 10, 12. This secures the rung 10, 12 to the ladder tube 10, 12. The rung protrusions 28*a-c* are each arranged on the rung 20 so that it corresponds to the mounting holes 14, 15, 19 of the ladder tube 10, 12.

In order to facilitate the assembly step in the manufacturing process the rung 20 may additionally or alternatively be arranged to the ladder tube 10, 12 using clamping.

In one embodiment, the clamping function is created by having a slot or slit 31 (shown in FIG. 4*a*) arranged in the first bracket section 24*a* and the second bracket section 24*b*. During mounting of the rung 20 to the ladder tube 10, 12 the slot is arranged in a slightly open positon, which allows for easier movement of the rung 20 to the ladder tube 10, 12 when arranging the rung 20 into its intend position. Once the rung 20 is in its intended position, the slot 31 is closed by locking means 32, such as a screw, that closes the slot 31 around the ladder tube 10, 12. The first bracket section 24*a* and the second bracket section 24*b* thus acts as a pipe clamp. The combination of a slit 31 and locking means 32 together with the fact that the rungs is constructed as an integrated unit, makes the rung less expensive to manufacture.

In one embodiment the rung 20 comprises a rung locking hole 29 which together with the locking hole 17 is used to receive a locking pin 27 (see FIG. 5*a-c*) used in the locking mechanism of the ladder.

Figure 4D:
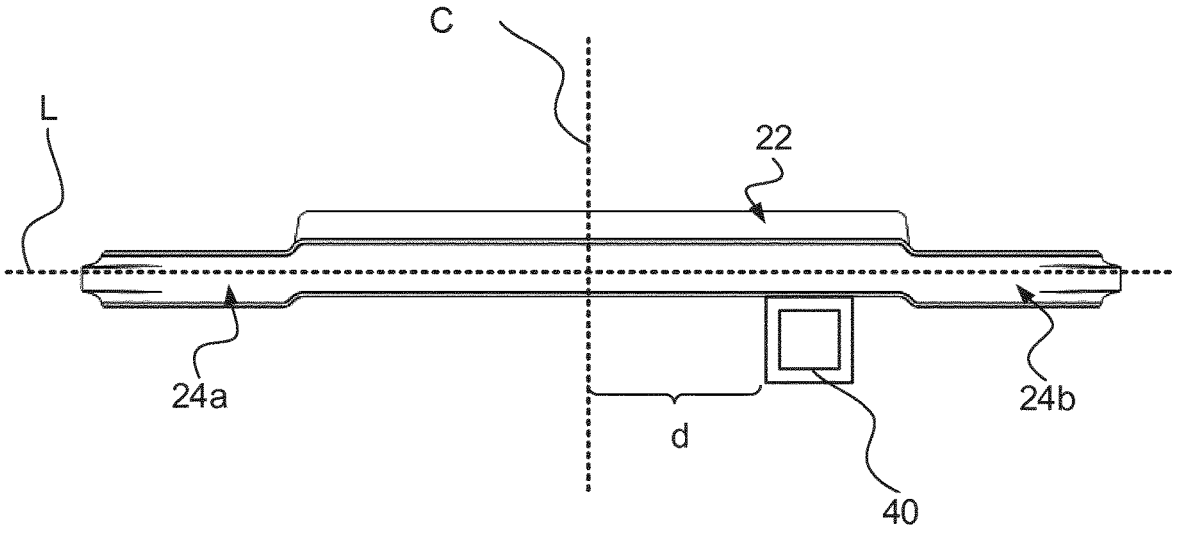
Figure 4E:
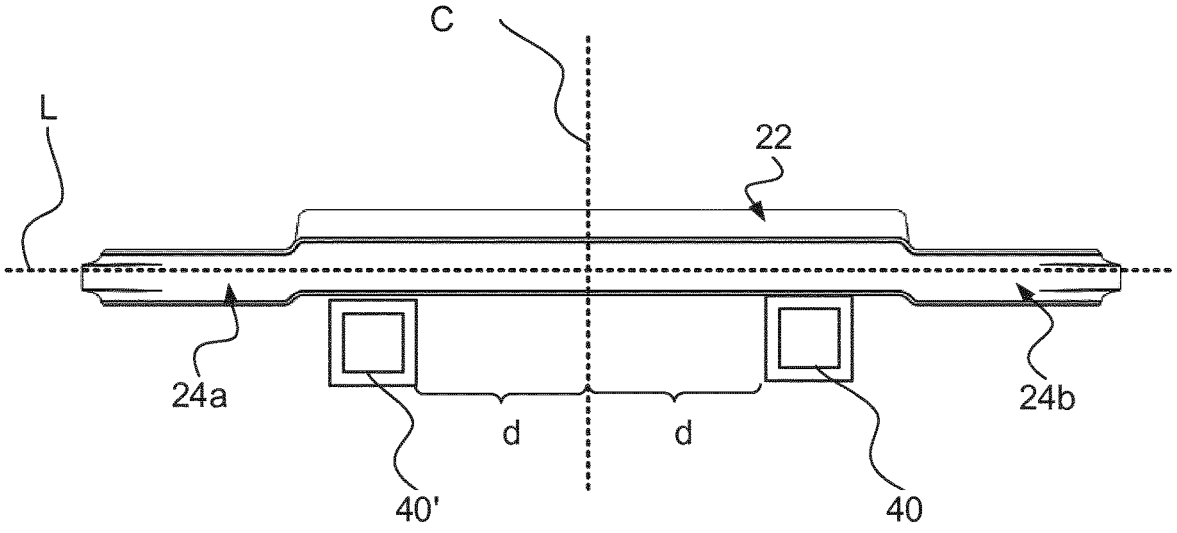

In FIG. 4*d-e* two different embodiments of a rung is shown comprising at least one grip handle 40. Having a ladder 1 where one rung 20 comprises at least one grip handle 40, 40' makes it easier for the user to carry and move around. The grip handle 40 or handles 40, 40' may be of any shape suitable to be carried, for example a rectangular handle, a rounded handle or a knob. The grip handle(s) 40, 40' may be provided on a bottom side of the rung, i.e. on the opposite side of the step surface 23.

The rung 20 shown in FIG. 4*d-e* has a central line C which is parallel with the ladder tubes 10, 12. The central line C is a vertical line arranged in the centre between the first and second bracket sections 24*a*, 24*b*. The central line C is perpendicular to a longitudinal line L which extends between the first and second bracket sections 24*a*, 24*b*.

As shown in FIG. 4*d* a single grip handle 40 is arranged at distance d from the central line C. Although the grip handle 40 is shown at the right hand side of the central line C, the grip handle 40 could also be arranged on the left hand side of the centre line.

In FIG. 4*e* a rung 20 is shown having two grip handles 40, 40'. Each grip handle is arranged at a distance d from the central line C. The distance d from the central line allows the user to carry the ladder with a beneficial angle, so as to distribute the weight of the ladder while carrying it.

Although not shown, the two grip handles 40, 40' could be arranged at different distances from the central line, for example one handle with a distance d from the central line and the other grip handle with a distance d2 from the central line, where the distance d2 could be either smaller or larger than the distance d.

In one embodiment the grip handle 40 is arranged on the bottom side of the rung as a separate unit. The grip handle and the rung are thus not constructed as a single unit.

In another embodiment the grip handle 40 is arranged in integral with the rung, and thus constructed as a single unit.

In yet another embodiment the grip handle 40 is provided on a bottom plate (not shown), where the bottom plate is removable arranged to the main section 22 of the rung 20. The bottom plate may be constructed in the same material as the rung 20.

Although not shown in the figures, it should be understood by the skilled person that the grip handle 40 may be arranged on only one or several rungs of a collapsible ladder.

The rung 20 shown in FIG. 4*a-e* does not comprise any actuators 30. This may be the case where only the second lowermost rung in ladder 1 has a pair of actuators 30 which are manually operated (such as a rotary button or a slide button) and all the other rungs are collapsed automatically by operating the actuator 30 of the second lowermost rung.

Figure 5A:
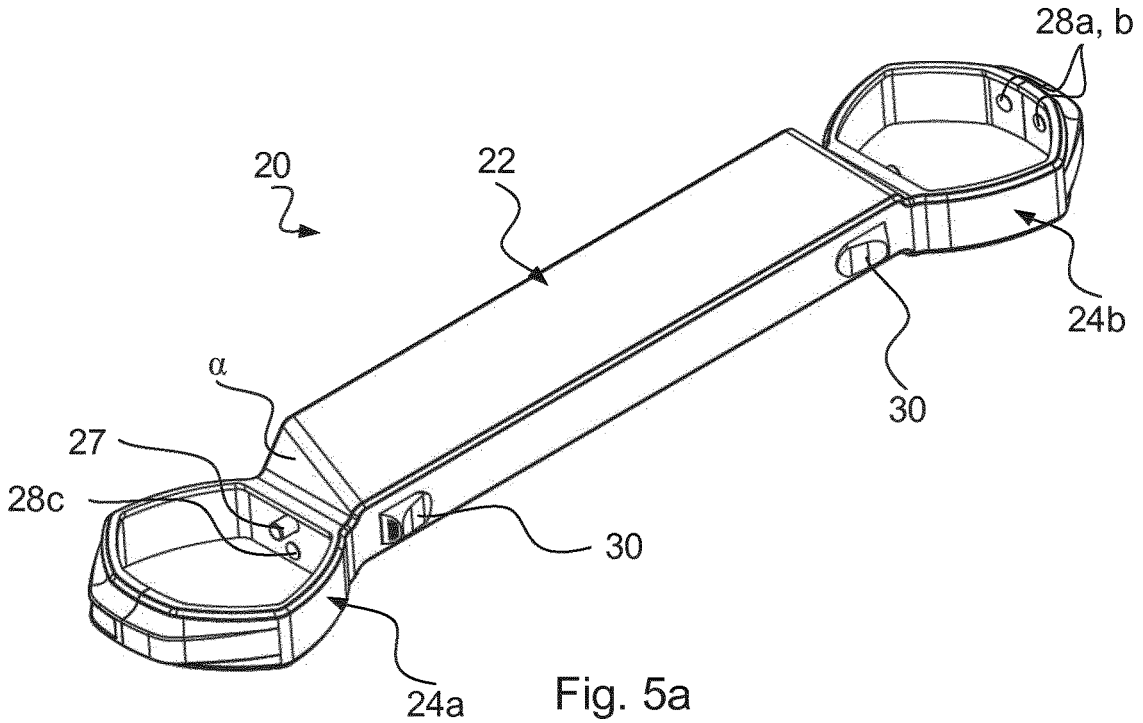
FIGS. 5*a-c* show different views of a rung according to an embodiment.
Figure 5B:
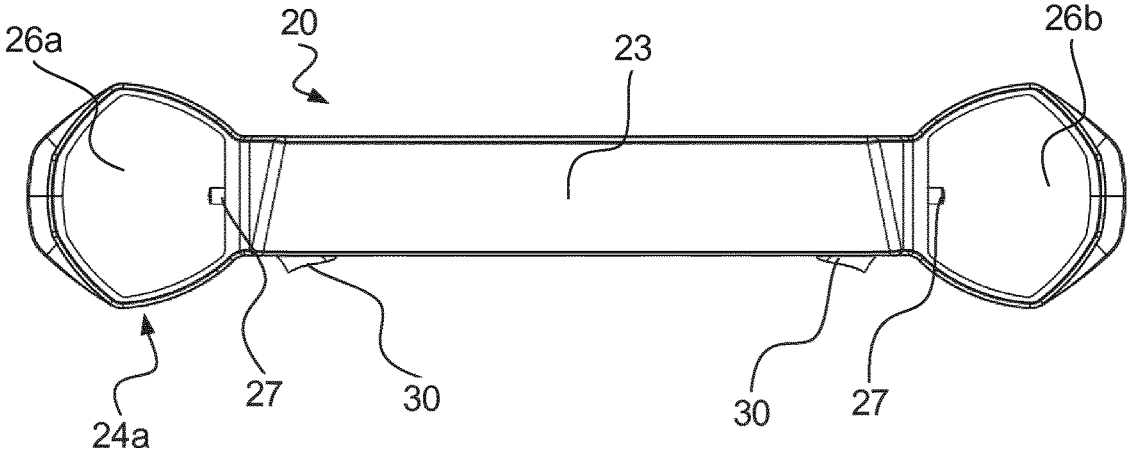
Figure 5C:
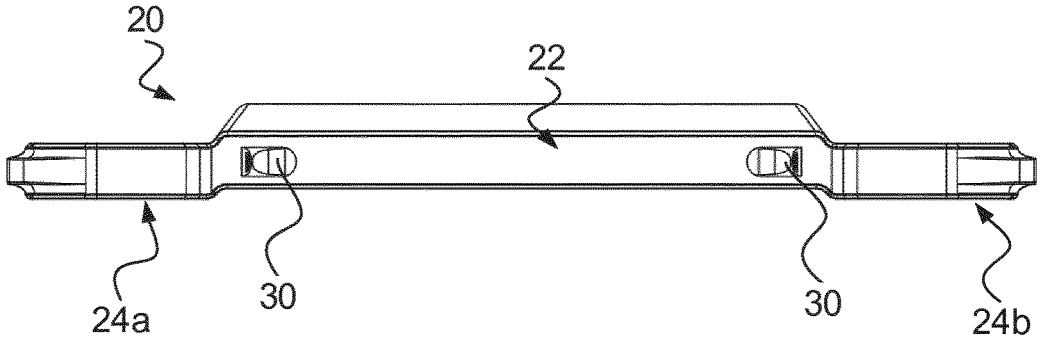

In FIG. 5*a-c* an embodiment of a rung 20 having a pair of actuators 30 is shown in different perspective views. The two actuators 30 are arranged in conjunction with the two bracket sections 24*a*, 24*b*. The spring-loaded locking pin 27 is arranged in the rung locking hole 29 of the rung 20. Here, the spring-loaded locking pin 27 is arranged on the straight section 16 of the rung 20.

In one embodiment the collapsible ladder 1 comprises locking indicators (not shown) on all or some rungs 20*a-k*. The locking indicator may have a green field to indicate that the locking mechanism associated with that locking indicator is activated and/or a red field to indicate that the locking indicator is inactivated. These indicating fields may be provided on a plate made of plastic or metal attached to the locking indicator. The locking indicator may be completely housed in the rung, but the plate with the green and red fields is visible through a recess in the rung. Alternatively the locking indicator can be arranged as colored portions of the locking pin 27.

Even though it has not been shown by the detailed embodiment or the drawings it is evident that the claimed rung can be used on a stepladder. A collapsible stepladder comprises a first and a second ladder leg. The legs are hingedly connected to each other in one end, and each of the ladder legs can be seen as an individual collapsible ladder.

It should be appreciated that even though numerous characteristics and advantages of the present invention have been set forth in the foregoing description, together with details of the structure and function of the invention, the description is only illustrative and changes may be made in detail, especially in matters of shape, size and arrangement of parts within the scope of the invention to the full extent indicated by the appended claims.

The invention claimed is:

1. A ladder tube for use in a ladder section of a collapsible ladder that includes several ladder sections, where each ladder section has two ladder tubes arranged parallel to each other and interconnected by a rung, and where each ladder tube is telescopically inserted into a ladder tube of a lower ladder section, wherein the ladder tube has a cross-sectional shape comprising:

only one straight section;

a first additional section connected to a first end of the straight section at an angle larger than 90 degrees;

a second additional section connected to a second end of the straight section at an angle larger than 90 degrees;

a third additional section connected to the first additional section;

a fourth additional section connected to the second additional section; and a fifth additional section interconnecting the third and the fourth additional sections;

wherein the first, the second, the third, the fourth, and the fifth additional sections have convex shapes.

2. The ladder tube according to claim 1, wherein the ladder tube is at least partly hollow.

3. A collapsible ladder comprising:

several ladder sections, each ladder section including two ladder tubes arranged parallel to each other, and a rung interconnecting the two ladder tubes;

wherein each ladder tube is telescopically inserted into a ladder tube of a lower section; and wherein each ladder tube has a cross-sectional shape including only one straight section, a first additional section connected to a first end of the straight section at an angle larger than 90 degrees, a second additional section connected to a second end of the straight section at an angle larger than 90 degrees, a third additional section connected to the first additional section, a fourth additional section connected to the second additional section, and a fifth additional section interconnecting the third and the fourth additional sections;

wherein the first, the second, the third, the fourth, and the fifth additional sections have convex shapes.

4. The collapsible ladder according to claim 3, wherein the rung of each ladder section comprises:

a main section;

a first bracket section arranged at a first end of the main section, and having an opening with the same shape as the cross-sectional shape of each ladder tube of the ladder section; and a second bracket section arranged at a second end of the main section, and having an opening with the same shape as the cross-sectional shape of each ladder tube of the ladder section.

5. A collapsible stepladder comprising:

a first ladder leg; and a second ladder leg hinge coupled to the first ladder leg;

wherein each ladder leg includes at least three ladder sections, each ladder section including two ladder tubes arranged parallel to each other, and a rung interconnecting the two ladder tubes;

wherein each ladder tube is telescopically inserted into the ladder tube of a lower ladder section; and wherein each ladder tube has a cross-sectional shape including only one straight section, a first additional section connected to a first end of the straight section at an angle larger than 90 degrees, a second additional section connected to a second end of the straight section at an angle larger than 90 degrees, a third additional section connected to the first additional section, a fourth additional section connected to the second additional section, and a fifth additional section interconnecting the third and the fourth additional sections;

wherein the first, the second, the third, the fourth, and the fifth additional sections have convex shapes.

* * * * *